US010896635B2

(12) United States Patent
Xi et al.

(10) Patent No.: US 10,896,635 B2
(45) Date of Patent: Jan. 19, 2021

(54) PRIMARY COLOR CONVERSION METHOD AND CONVERTER THEREOF, DISPLAY CONTROL METHOD, AND DISPLAY DEVICE

(71) Applicant: BOE TECHNOLOGY GROUP CO., LTD., Beijing (CN)

(72) Inventors: Yanhui Xi, Beijing (CN); Bin Dai, Beijing (CN); Xiaomang Zhang, Beijing (CN); Yan Sun, Beijing (CN); Kuanjun Peng, Beijing (CN); Haijun Niu, Beijing (CN); Xiaolong Li, Beijing (CN); Donghui Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/482,107

(22) PCT Filed: Sep. 27, 2018

(86) PCT No.: PCT/CN2018/107810

§ 371 (c)(1),
(2) Date: Jul. 30, 2019

(87) PCT Pub. No.: WO2019/114369

PCT Pub. Date: Jun. 20, 2019

(65) Prior Publication Data

US 2020/0226965 A1 Jul. 16, 2020

(30) Foreign Application Priority Data

Dec. 13, 2017 (CN) ..... 2017 1 1334388

(51) Int. Cl.
*G09G 3/20* (2006.01)

(52) U.S. Cl.
CPC ... *G09G 3/2003* (2013.01); *G09G 2320/0626* (2013.01); *G09G 2320/0666* (2013.01)

(58) Field of Classification Search
CPC ..... G09G 3/2003; G09G 2320/0626; G09G 2320/0666
See application file for complete search history.

(56) References Cited

U.S. PATENT DOCUMENTS 5,937,089 A * 8/1999 Kobayashi ..... H04N 1/6027 358/518
2004/0264193 A1* 12/2004 Okumura ..... H05B 45/00 362/276

(Continued)

FOREIGN PATENT DOCUMENTS

CN 1697009 A 11/2005
CN 103026401 A 4/2013

(Continued)

OTHER PUBLICATIONS

International Search Report and Written Opinion issued in corresponding PCT/CN2018/107810, dated Jan. 9, 2019, with English translation.

(Continued)

*Primary Examiner* — Vinh T Lam
(74) *Attorney, Agent, or Firm* — McDermott Will and Emery LLP

(57) ABSTRACT

Disclosed is a primary color conversion method, which may expand primary color signals that are applicable to a display device. The primary color conversion method includes: acquiring color coordinates and a brightness value of a first color in a first color gamut having M primary colors according to gray-scale values of the M primary colors corresponding to the first color; and mapping the color coordinates and the luminance value of the first color in the first color gamut to color coordinates and a brightness value of a second color (Continued)

corresponding to the first color in a second color gamut having N primary colors. 3≤M, 3≤N, M is different from N, and M and N are positive integers.

19 Claims, 4 Drawing Sheets

(56) References Cited

U.S. PATENT DOCUMENTS

| | | | | |
|---|---|---|---|---|
| 2012/0194539 | A1* | 8/2012 | Zhang | H04N 9/67 345/590 |
| 2014/0043371 | A1* | 2/2014 | Langendijk | G09G 3/3607 345/690 |
| 2015/0154762 | A1* | 6/2015 | Yang | G09G 3/2003 345/603 |
| 2016/0210891 | A1* | 7/2016 | Zhang | G09G 3/3607 |
| 2016/0293086 | A1* | 10/2016 | Zhang | G09G 3/3611 |

FOREIGN PATENT DOCUMENTS

| | | | |
|---|---|---|---|
| CN | 103440837 | A | 12/2013 |
| CN | 107316602 | A | 11/2017 |
| CN | 107863081 | A | 3/2018 |

OTHER PUBLICATIONS

First Office Action issued in corresponding Chinese Application No. 2017113343889, dated Feb. 28, 2019, with English translation.
Second Office Action issued in corresponding Chinese Application No. 201711334388.9, dated May 22, 2019, with English translation.

* cited by examiner

PRIMARY COLOR CONVERSION METHOD AND CONVERTER THEREOF, DISPLAY CONTROL METHOD, AND DISPLAY DEVICE

CROSS-REFERENCE TO RELATED APPLICATION

This application is a national phase entry under 35 USC 371 of International Patent Application No. PCT/CN2018/107810 filed on Sep. 27, 2018, which claims priority to Chinese Patent Application No. 201711334388.9, filed with Chinese Patent Office on Dec. 13, 2017, titled "A MULTI-PRIMARY CONVERSION METHOD AND MULTI-PRIMARY CONVERTER, DISPLAY CONTROL METHOD, AND DISPLAY DEVICE", which are incorporated herein by reference in their entirety.

TECHNICAL FIELD

The present application relates to the field of display technologies, and in particular, to a primary color conversion method and a primary color converter, a display control method, and a display device.

BACKGROUND

With the development of display technologies, display devices have been widely used in electronic products such as mobile phones, televisions, and computers. At present, due to a limited range of a color gamut of three-primary-color (RGB) display devices, users' requirements for high-performance screens cannot be met.

SUMMARY

An aspect of some embodiments of the present disclosure provides a primary color conversion method. The primary color conversion method includes:

obtaining color coordinates and a luminance value of a first color in a first color gamut having M primary colors according to gray-scale values of the M primary colors corresponding to the first color; and mapping the color coordinates and the luminance value of the first color in the first color gamut to color coordinates and a luminance value of a second color corresponding to the first color in a second color gamut having N primary colors; wherein 3 is less than or equal to M, 3 is less than or equal to N, M is different from N, and M and N are both positive integers.

In some embodiments of the present disclosure, mapping the color coordinates and the luminance value of the first color in the first color gamut to color coordinates and a luminance value of a second color corresponding to the first color in a second color gamut having N primary colors, includes:

mapping a color coordinate point A of the first color in the first color gamut to a color coordinate A1 of the second color corresponding to the first color in the second color gamut having N primary colors, wherein a process of mapping the color coordinate point A of the first color to the color coordinate point A1 of the second color is equal scale mapping.

In some embodiments of the present disclosure, mapping a color coordinate point A of the first color in the first color gamut to a color coordinate A1 of the second color corresponding to the first color in the second color gamut having N primary colors, a process of mapping the color coordinate point A of the first color to the color coordinate point A1 of the second color being equal scale mapping, includes:

drawing a mapping line segment in a chromaticity diagram, the mapping line segment extending from a color coordinate point D of a white color to the color coordinate point A of the first color;

obtaining a first intersection point P between an extension line of the mapping line segment and a boundary of the first color gamut, and a second intersection point $P_1$ between the extension line of the mapping line segment and a boundary of the second color gamut; and obtaining the color coordinate point A1 of the second color according to a formula: DA/DP=DA1/$DP_1$, wherein DA is a length of a line segment between the color coordinate point D of the white color and the color coordinate point A of the first color; DP is a length of a line segment between the color coordinate point D of the white color and the first intersection point P; DA1 is a length of a line segment between the color coordinate point D of the white color and the color coordinate point A1 of the second color; and $DP_1$ is a length of a line segment between the color coordinate point D of the white color and the second intersection point $P_1$.

In some embodiments of the present disclosure, mapping the color coordinates and the luminance value of the first color in the first color gamut to color coordinates and a luminance value of a second color corresponding to the first color in a second color gamut having N primary colors, includes:

obtaining a maximum luminance value $Y_{max}(x, y)$ of the first color in the first color gamut;

obtaining a maximum luminance value $Y_{1max}(x\mathbf{1}, y\mathbf{1})$ of the second color in the second color gamut; and obtaining a luminance value $Y_{1max}(x\mathbf{1}, y\mathbf{1})$ of the second color in the second color gamut according to a formula:

$$\frac{Y(x, y)}{Y_{max}(x, y)} = \frac{Y_1(x1, y1)}{Y_{1max}(x1, y1)},$$

Y(x, y) is a luminance value of the first color in the first color gamut.

In some embodiments of the present disclosure, obtaining a maximum luminance value $Y\mathbf{1}_{max}(x\mathbf{1}, y\mathbf{1})$ of the second color in the second color gamut, includes:

obtaining a three-dimensional diagram of the second color gamut in a color space; and obtaining, along a direction of a luminance coordinate axis of the color space, a point, which corresponds to the color coordinate point of the second color in the second color gamut, on a boundary of the three-dimensional diagram of the second color gamut, a value of the point on the luminance coordinate axis being a maximum luminance value $Y_{1max}(x\mathbf{1}, y\mathbf{1})$ of the second color in the second color gamut.

In some embodiments of the present disclosure, obtaining a maximum luminance value $Y_{max}(x, y)$ of the first color in the first color gamut, includes:

obtaining tristimulus values of the first color in the first color gamut according to gray-scale values of the M primary colors corresponding to the first color and a conversion matrix of the first color gamut, and using a Y value of the tristimulus values of the first color in the first color gamut as a luminance value Y(x, y) of the first color in the first color gamut; wherein a ratio of the maximum luminance value $Y_{max}(x, y)$ of the first color in the first color gamut to the luminance value Y(x, y) of the first color in the first color gamut is equal to a ratio of a maximum value within a gray-scale range to a maximum value of gray-scale values of the M primary colors corresponding to the first color.

In some embodiments of the present disclosure, obtaining a maximum luminance value $Y_{max}(x, y)$ of the first color in the first color gamut, includes:

obtaining a three-dimensional diagram of the first color gamut in a color space; and obtaining, along a direction of a luminance coordinate axis of the color space, a point, which corresponds to the color coordinate point of the first color in the first color gamut, on a boundary of the three-dimensional diagram of the first color gamut, a value of the point on the luminance coordinate axis being a maximum luminance value $Y_m(x, y)$ of the first color in the first color gamut.

In some embodiments of the present disclosure, obtaining color coordinates of a first color in the first color gamut, includes:

obtaining tristimulus values of the first color in the first color gamut according to gray-scale values of the M primary colors corresponding to the first color and a conversion matrix of the first color gamut; and obtaining color coordinates of the first color in the first color gamut according to the tristimulus values of the first color in the first color gamut.

In some embodiments of the present disclosure, M is less than N.

Another aspect of some embodiments of the present disclosure provides a display control method for controlling a display device to perform display. The display device includes a plurality of pixel units; each pixel unit includes sub-pixels of N primary colors; 3 is less than or equal to N, and N is a positive integer. The display control method includes:

obtaining gray-scale values of sub-pixels of M primary colors corresponding to a pixel unit from an original image, the M primary colors of the sub-pixels being in one-to-one correspondence with the M primary colors of a first color gamut; wherein the original image corresponds to display signals with the M primary colors, 3 is less than or equal to M ($3 \leq M$), M is different from N, and M and N are both positive integers;

using the primary color conversion method in the above aspect to obtain color coordinates and a luminance value of a color to be displayed of the pixel unit in a second color gamut having N primary colors; and obtaining gray-scale values of the sub-pixels of N primary colors in the pixel unit according to the color coordinates and the luminance value of the color to be displayed of the pixel unit in the second color gamut, wherein the N primary colors of the sub-pixels are in one-to-one correspondence with the N primary colors of the second color gamut.

Yet another aspect of some embodiments of the present disclosure provides a computer device, which includes a memory and a processor. The memory has stored thereon a computer program executable on the processor, and the computer program, when executed by the processor, implements any one of the primary color conversion methods described above.

Yet another aspect of some embodiments of the present disclosure provides a non-transitory computer-readable storage medium storing a computer program that, when executed by a processor, implements any one of the primary color conversion methods described above.

Yet another aspect of some embodiments of the present disclosure provides a primary color converter for performing primary color conversion by using any one of the primary color conversion methods described above. The primary color converter includes a first data processor and a second data processor.

The first data processor is configured to obtain color coordinates and a luminance value of a first color in a first color gamut having M primary colors according to gray-scale values of the M primary colors corresponding to the first color.

The second data processor is coupled to the first data processor, and the second data processor is configured to map the color coordinates and the luminance value of the first color in the first color gamut to color coordinates and a luminance value of a second color corresponding to the first color in a second color gamut having N primary colors.

3 is less than or equal to M, 3 is less than or equal to N, M is different from N, and M and N are both positive integers.

Yet another aspect of some embodiments of the present disclosure provides a display device, which includes a plurality of pixel units. Each pixel unit includes N sub-pixels; N is greater than or equal to 3, and N is a positive integer.

The display device further includes the primary color converter described above.

DETAILED DESCRIPTION

In order to make the objects, technical solutions and advantages of embodiments of the present disclosure clearer, the technical solutions in the embodiments of the present disclosure will be described clearly and completely with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

In the related art, a multi-primary display device with more than three primary colors is proposed. That is, the display device includes a plurality of pixel units, and the number of sub-pixels included in each pixel unit is equal to the number of the primary colors. However, due to influence of an industry chain problem, at present, it is not possible to provide multi-primary display signals directly to the multi-primary display device. In this case, since the multi-primary display device has a larger color gamut range than a three-primary-color display device, if three-primary-color display signals are not processed (for example, if a color gamut thereof is not expanded), and are directly transmitted to the multi-primary display device, it is not possible to fully and effectively utilize all display capabilities of the multi-primary display device. As a result, it is not possible for the multi-primary display device to truly achieve multi-primary display.

Figure 1:
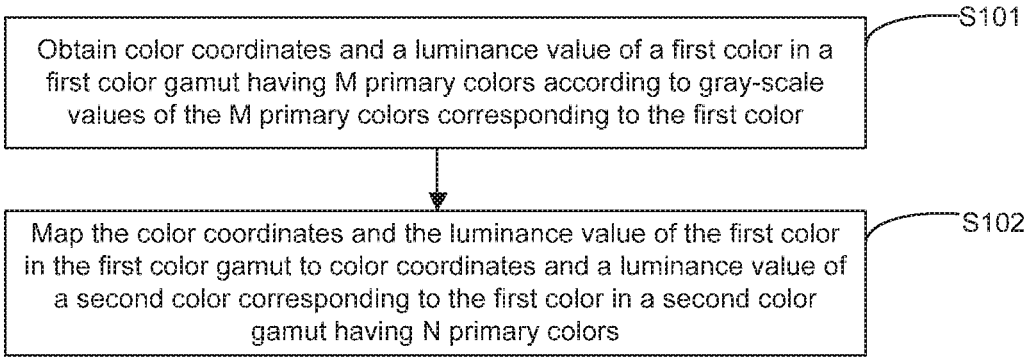
FIG. 1 is a flow chart of a primary color conversion method, in accordance with some embodiments of the present disclosure.

Some embodiments of the present disclosure provide a primary color conversion method. As shown in FIG. 1, the method includes S101 and S102.

Figure 2:
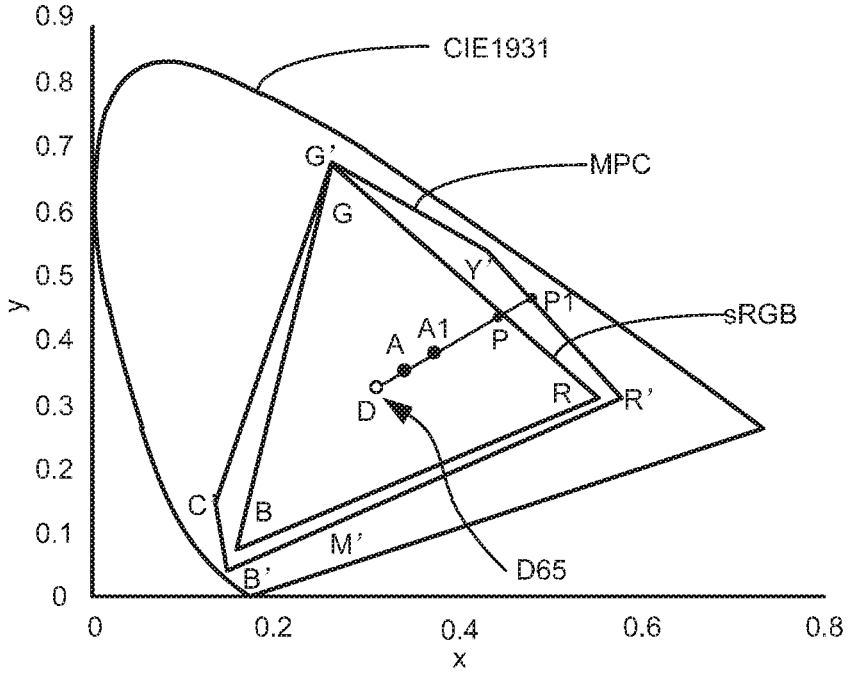
FIG. 2 is a schematic diagram of two color gamuts in a chromaticity diagram, in accordance with some embodiments of the present disclosure.

In S101, as shown in FIG. 2, color coordinates A(x, y) and a luminance value Y of a first color (e.g., point A) in a first color gamut (e.g., standard red green blue (sRGB)) having M primary colors are obtained according to gray-scale values of the M primary colors corresponding to the first color (e.g., point A).

In some embodiments of the present disclosure, in the above primary color conversion process, the gray-scale values may be gray-scale values that have not been normalized, and the gray-scale values are within a range of 0 to a difference between $2^k$ and 1 ($2^k-1$) (k is a positive integer). Alternatively, the gray-scale values may be gray-scale values that have been normalized, and the gray-scale values are within a range of 0 to 1, which is not limited by the present disclosure.

M is greater than or equal to 3 (M≥3), and M is a positive integer. For convenience of explanation, in some embodiments of the present disclosure, as shown in FIG. 2, a description is made by taking an example in which M is equal to 3 (M=3), and the first color gamut is a standard red green blue (sRGB) color gamut consisting of three primary colors of R (red), G (green), and B (blue).

In the CIE 1931 chromaticity diagram, a triangle formed by connecting coordinate points of the three primary colors of R, G, and B is a range of the first color gamut.

The above "sRGB color gamut" refers to a standard red green blue color gamut, and sRGB is an abbreviation of "standard red green blue". The above "CIE 1931 chromaticity diagram" refers to a chromaticity diagram formulated by the International Commission on Illumination (also known as Commission Internationale de L'Eclairage, CIE) in 1931.

In this case, S101 includes sub-step 101*a* to sub-step 101*b* (S101*a* to S101*b*).

In S101*a*, tristimulus values (X, Y, Z) of the first color (e.g., point A) in the first color gamut (sRGB) are obtained according to gray-scale values of the M primary colors (R, G, B) corresponding to the first color (e.g., point A) and a conversion matrix Tn1 of the first color gamut (sRGB).

The conversion matrix Tn1 of the first color gamut (sRGB) is a conversion matrix between the tristimulus values (X, Y, Z) of the first color (e.g., point A) in the first color gamut (sRGB) and the gray-scale values of the M primary colors (R, G, B) corresponding to the first color (e.g., point A).

For example, the tristimulus values (X, Y, Z) of the first color (e.g., point A) in the first color gamut (sRGB), the gray-scale values (R, G, B) of the M primary colors corresponding to the first color, and the conversion matrix Tn1 of the first color gamut (sRGB) satisfy the following formula (1):

$$\begin{pmatrix} X \\ Y \\ Z \end{pmatrix} = Tn1 \times \begin{pmatrix} R \\ G \\ B \end{pmatrix}; \quad (1)$$

$$Tn1 = \begin{pmatrix} X_R & X_G & X_B \\ Y_R & Y_G & Y_B \\ Z_R & Z_G & Z_B \end{pmatrix}.$$

In this case, through the above formula (1), a Y value of the tristimulus values (X, Y, Z) of the first color (e.g., point A) in the first color gamut (sRGB) may be obtained and used as a luminance value Y of the first color (e.g., point A) in the first color gamut (sRGB).

In S101*b*, color coordinates (x, y) of the first color (e.g., point A) in the first color gamut (sRGB) are obtained according to the tristimulus values (X, Y, Z) of the first color (e.g., point A) in the first color gamut (sRGB).

For example, the tristimulus values (X, Y, Z) of the first color (e.g., point A) in the first color gamut (sRGB) and the color coordinates (x, y) of the first color (e.g., point A) in the first color gamut (sRGB) satisfy the following formula (2):

$$x = \frac{X}{X+Y+Z} \quad (2)$$

$$y = \frac{Y}{X+Y+Z}$$

$$z = \frac{Z}{X+Y+Z}.$$

Therefore, the color coordinates (x, y) and the luminance value Y of the first color (e.g., point A) in the first color gamut (sRGB) are obtained.

In S102, the color coordinates A(x, y) and the luminance value (Y) of the first color (e.g., point A) in the first color gamut (sRGB) are mapped to color coordinates A1(x1, y1) and a luminance value Y1 of a second color (e.g., point A1), which corresponds to the first color, in a second color gamut having N primary colors.

3 is less than or equal to N(3≤N), M is different from N, and N is a positive integer.

In a case where M is less than N (M<N), the above primary color conversion method is for example a multi-primary conversion method (Multi-SubPixel-Production, MSP), and the second color gamut is a multi-primary color (MPC) gamut.

For convenience of explanation, a description is made by taking an example in which N is equal to 6 (N=6), and the second color gamut (MPC gamut) is a MPC gamut consisting of six primary colors of R', G', B', Y', C', and M'. Herein, R' stands for a red color, G' stands for a green color, B' stands for a blue color, Y' stands for a yellow color, C' stands for a cyan color, and M' stands for a magenta color. In the CIE 1931 chromaticity diagram, a hexagon formed by connecting coordinate points of the six primary colors of R', G', B', Y', C' and M' is a range of the second color gamut (MPC gamut).

For example, in a case where N is equal to 5 (N=5), the second color gamut (MPC gamut) is a MPC gamut consisting of five primary colors of R', G', B', Y' and C'. In a case where N is equal to 4 (N=4), the second color gamut (MPC gamut) is a MPC gamut consisting of four primary colors of R', G', B' and Y'.

Hereinafter, for convenience of explanation, descriptions are all made by taking an example in which the second color gamut (MPC gamut) includes six primary colors.

In some embodiments of the present disclosure, the first color (e.g., point A) and the second color (e.g., point A1) may be the same or different.

For example, as shown in FIG. 2, in a case where an extension line of a line segment DA (from a color coordinate point D of a white color to a color coordinate point A of the first color) passes through point A1 and intersects with both the first color gamut (sRGB) and the second color gamut (MPC) to form a first intersection point P and a second intersection point P1 respectively, the first color (e.g., point A) is different from the second color (e.g., point A1). In this case, it is necessary to extend the first color (e.g., point A) in the first color gamut (sRGB) into the second color gamut (MPC) to form a second color (e.g., point A1).

Alternatively, in a case where the color coordinate point A of the first color is located on a line segment DG (from the color coordinate point D of the white color to a boundary point G of the color gamuts), since on the boundary point G, a boundary of the first color gamut (sRGB) overlaps with a boundary of the second color gamut (MPG), it is not necessary to extend or compress the first color in the process of converting from the first color gamut (sRGB) to the second color gamut (MPC). In this case, the color coordinate point A before conversion overlaps with the color coordinate point A1 after conversion. That is, the first color (e.g., point A) and the second color (e.g., point A1) are the same.

As can be seen from the above, through the color gamut conversion method provided by the embodiments of the present disclosure, it may be possible to map the first color in the first color gamut having M primary colors to the second color gamut having the different number of primary colors (instead of M primary colors), so as to expand primary color signals that are applicable to the display device.

For example, in a case where M is less than N (M<N), M is for example equal to 3, and N is for example equal to 6, the first color (e.g., point A) in the first color gamut (sRGB) may be extended to the second color gamut (MPC), and color coordinates and a luminance value of a second color (e.g., point A1) in the second-color gamut (MPC) may be obtained after extending. Since the second color (e.g., point A1) has N primary colors (e.g., six primary colors of R', G', C', and M') the number of primary colors of the second color (e.g., point A1) may be matched with the number of primary colors of the multi-primary display device (e.g., a six-primary color display device). In this way, the multi-primary display device may be able to display a wider color gamut when displaying the second color (e.g., point A1), thereby improving an expressiveness of an image.

Alternatively, in a case where N is less than M (N<M), the first color in the first color gamut may be compressed to the second color gamut, and color coordinates and a luminance value of a second color in the second color gamut may be obtained after compression.

Figure 3:
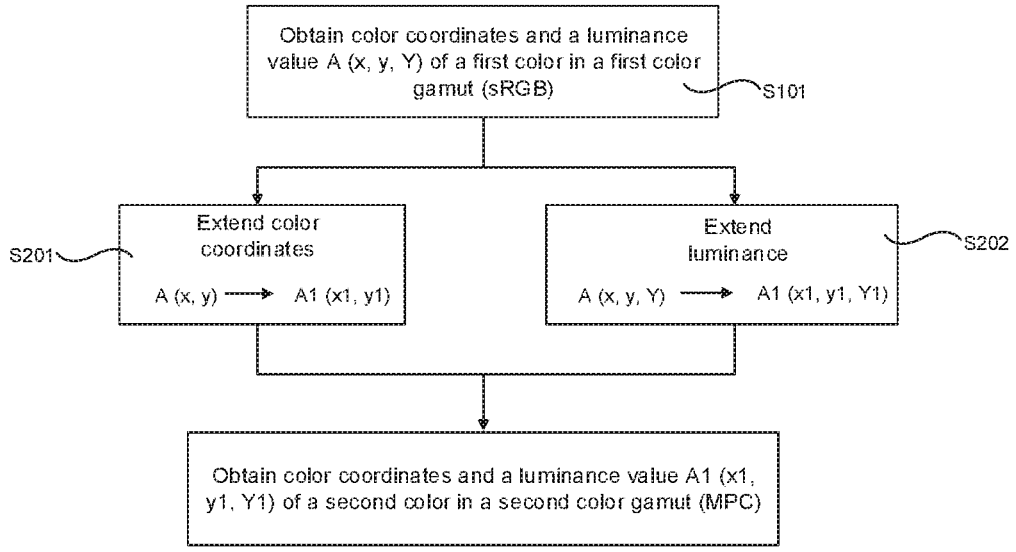
FIG. 3 is a flow chart of implementing the steps in FIG. 1.

A multi-primary conversion process will be described in detail below. S101 is performed, so as to obtain color coordinates and a luminance value A(x, y, Y) of the first color (e.g., point A) in the first color gamut (sRGB), as shown in FIG. 3.

S102 is performed, so as to obtain color coordinates and a luminance value A1(x1, y1, Y1) of a second color (e.g., point A1) corresponding to the first color in the second color gamut (MPC).

For example, S102 includes sub-steps 201 and 202 (S201 and S202).

In S201, the color coordinates A(x, y) of the first color (e.g., point A) in the first color gamut (sRGB) are extended to color coordinates A1 (x1, y1) of a second color (e.g., point A1) in the second color gamut (MPC).

The color coordinates A(x, y) of the first color (e.g., point A) in the first color gamut (sRGB) may be mapped to color coordinates A1 (x1, y1) of the second color (e.g., point A1) in the second color gamut (MPC) having N primary colors (e.g., six primary colors) through equal scale mapping. The above step includes the following process 201*a* to process 201*c* (S201*a* to S201*c*).

In S201*a*, as shown in FIG. 2, a mapping line segment is drawn in a chromaticity diagram (CIE 1931, xy planar graph). The mapping line segment extends from the color coordinate point D of the white color to the color coordinate point A of the first color.

It will be noted that, the color coordinate point D of the white color is the color coordinate point D65 of white light of equal energy spectrum, and a position of the color coordinate point D of the white color does not change in any color gamut.

In S201*b*, a first intersection point P between an extension line of the mapping line segment and a boundary of the first color gamut (sRGB) is obtained, and a second intersection point $P_1$ between the extension line of the mapping line segment and a boundary of the second color gamut (MPC) is obtained.

In S201*c*, a color coordinate point A1 of the second color is obtained according to the following formula (3).

Since a process of mapping the color coordinate point A of the first color in the first color gamut (sRGB) to the color coordinate point A1 of the second color in the second color gamut (MPC) is equal scale mapping, the color coordinate point A of the first color in the first color gamut (sRGB) and the color coordinate point A1 of the second color in the second color gamut (MPC) satisfy the following formula (3):

$$\frac{DA}{DP} = \frac{DA1}{DP_1}. \tag{3}$$

DA is a length of a line segment between the color coordinate point D of the white color and the color coordinate point A of the first color; DP is a length of a line segment between the color coordinate point D of the white color and the first intersection point P; DA1 is a length of a line segment between the color coordinate point D of the white color and the color coordinate point A1 of the second color; and $DP_1$ is a length of a line segment between the color coordinate point D of the white color and the second intersection point $P_1$.

Since lengths of the line segment DA, the line segment DP, and the line segment $DP_1$ can be obtained through a corresponding measuring device, a length of the line segment DA1 may be obtained through the above formula (3). Therefore, the color coordinate point A1 (x1, y1) of the second color in the second color gamut (MPC) may be obtained.

A process of obtaining the color coordinate point A1 (x1, y1) of the second color in the second color gamut (MPC) will be described in detail below.

As shown in FIG. 2, an equation $y_{GR}$ of a straight line GR is:

$$y_{GR} = \frac{y_G - y_R}{x_G - x_R}(x - x_G) + y_G;$$

$$\text{Let } k1 = \frac{y_G - y_R}{x_G - x_R}; \text{ Then } y_{GR} = k1(x - x_G) + y_G.$$

An equation $y_{Y'R'}$ of a straight line Y'R' is:

$$y_{Y'R'} = \frac{y_{Y'} - y_{R'}}{x_{Y'} - x_{R'}}(x - x_{R'}) + y_{R'};$$

$$\text{Let } k2 = \frac{y_{Y'} - y_{R'}}{x_{Y'} - x_{R'}}; \text{ Then } y_{Y'R'} = k2(x - x_{R'}) + y_{R'}.$$

An equation $Y_{DA}$ of a mapping line segment DA is:

$$y_{DA} = \frac{y_A - y_D}{x_A - x_D}(x - x_D) + y_D;$$

$$\text{Let } k3 = \frac{y_A - y_D}{x_A - x_D}; \text{ Then } y_{DA} = k3(x - x_D) + y_D.$$

Therefore, an x coordinate $x_p$ and a y coordinate $y_p$ of the first intersection point $P(x_p, y_p)$ between the extension line of the mapping line segment and the boundary of the first color gamut (sRGB), that is, the straight line GR, are obtained. The two coordinates are respectively:

$$x_p = \frac{(k1x_G - y_G) - (k3x_D - y_D)}{k1 - k3};$$

$$y_p = \frac{(x_D - x_G)k1k3 - (k1y_D - k3y_G)}{k3 - k1}.$$

An x coordinate $x_{p1}$ and a y coordinate $y_{p1}$ of the second intersection point $P_1$ between the extension line of the mapping line segment and the boundary of the second color gamut (MPC), that is, the straight line Y'R', are obtained. The two coordinates are respectively:

$$x_{p1} = \frac{(k2x_{R'} - y_{R'}) - (k3x_D - y_D)}{k2 - k3};$$

$$y_{p1} = \frac{(x_D - x_{R'})k2k3 - (k2y_D - k3y_{R'})}{k3 - k2}.$$

In this case, according to the above formula (3), the color coordinate point A1 (x1, y1) of the second color in the second color gamut (MPC) may be obtained:

$$\frac{x_D - x_A}{x_D - x_P} = \frac{x_D - x_{A1}}{x_D - x_{P1}} \Rightarrow x_{A1} = x_D - \frac{(x_D - x_A)\times(x_D - x_{P1})}{x_D - x_P};$$

-continued $$\frac{y_D - y_A}{y_D - y_P} = \frac{y_D - y_{A1}}{y_D - y_{P1}} \Rightarrow y_{A1} = y_D - \frac{(y_D - y_A)\times(y_D - y_{P1})}{y_D - y_P};$$

x1 is equal to $x_{A1}$ (x1=$x_{A1}$), and y1 is equal to $y_{A1}$ (y1=$y_{A1}$).

Figure 5:
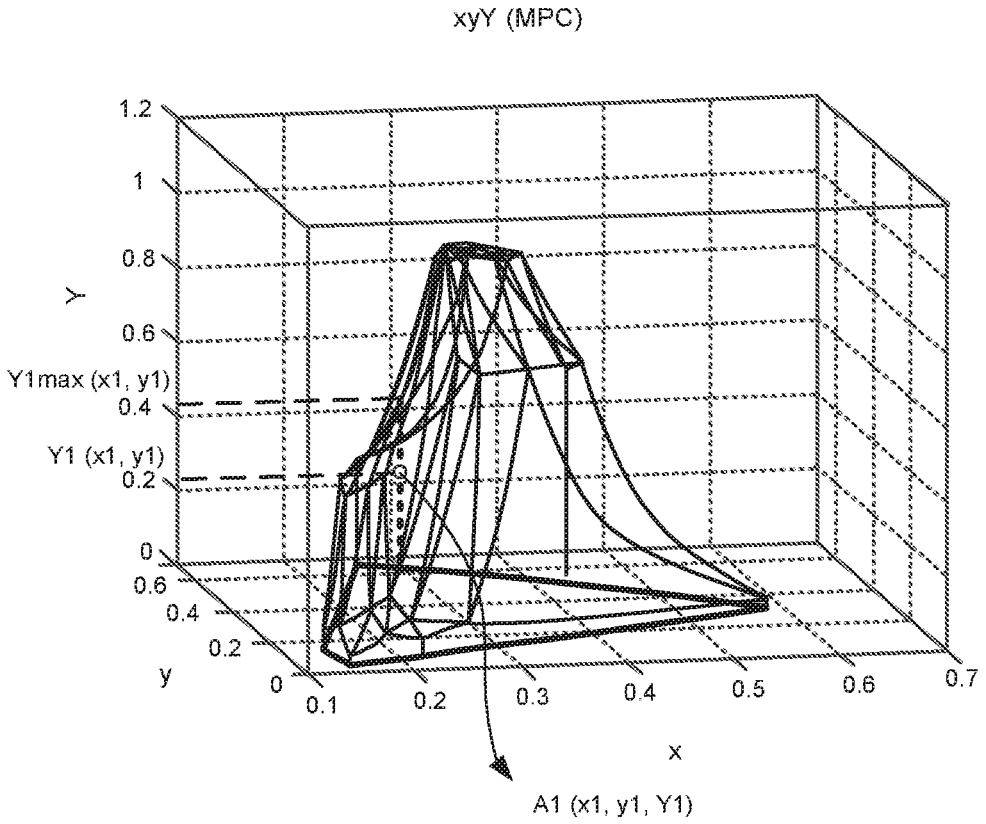
FIG. 5 is a three-dimensional diagram of a color space with six primary colors, in accordance with some embodiments of the present disclosure.

In S202, as shown in FIGS. 3 and 5, the luminance value Y of the first color (e.g., point A) in the first color gamut (sRGB) is extended to the luminance value Y1 of the second color (e.g., point A1) in the second color gamut (MPC).

For example, the step of mapping the luminance value Y of the first color (e.g., point A) in the first color gamut (sRGB) to the luminance value Y1 of the second color in the second color gamut (MPC) having N primary colors (e.g., six primary colors), includes the following process 202*a* and process 202*b* (S202*a* and S202*b*), or, process 202*a*' and process 202*b*' (S202*a*' and S202*b*').

In S202*a*, according to the above formula (1), tristimulus values of the first color (e.g., point A) in the first color gamut (sRGB) are obtained, and a Y value of the tristimulus values is used as a luminance value Y(x, y) of the first color (e.g., point A) in the first color gamut (sRGB).

Figure 4:
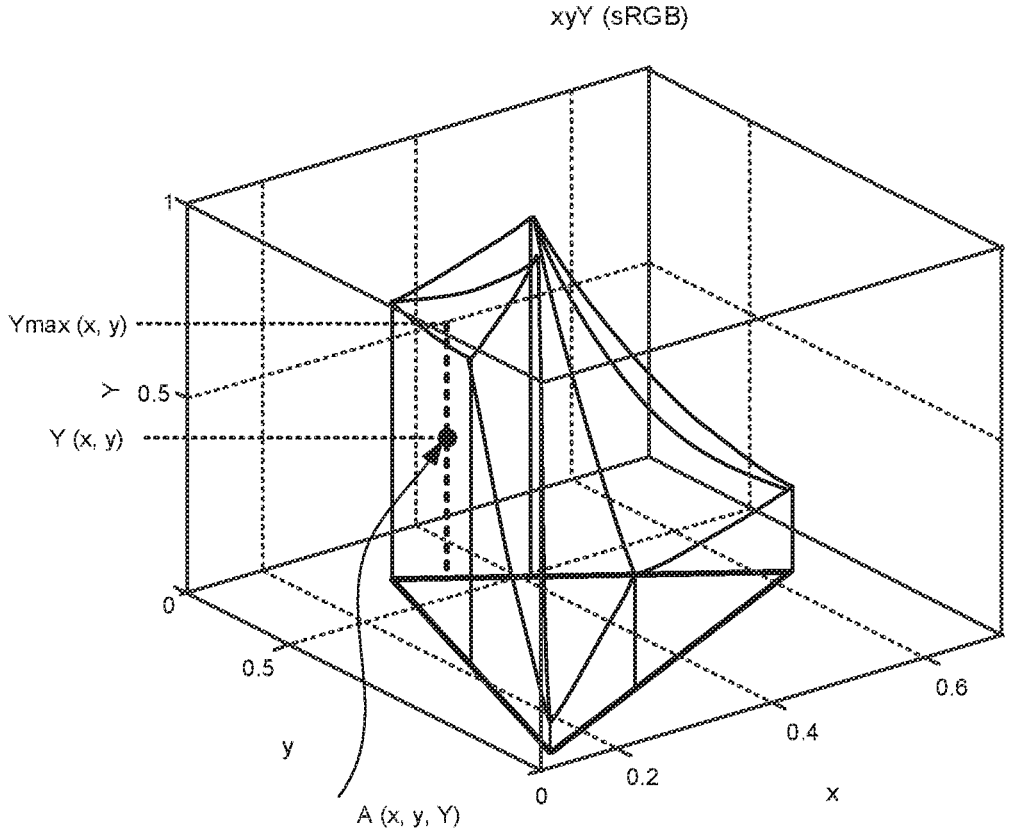
FIG. 4 is a three-dimensional diagram of a color space with three primary colors, in accordance with some embodiments of the present disclosure.

In S202*b*, as shown in FIG. 4, according to the luminance value Y(x, y) of the first color (e.g., point A) in the first color gamut (sRGB), a maximum luminance value $Y_{max}$(x, y) of the first color (e.g., point A) in the first color gamut (sRGB) is obtained.

For example, the luminance value Y(x, y) of the first color (e.g., point A) in the first color gamut (sRGB) and the maximum luminance value $Y_{max}$(x, y) of the first color (e.g., point A) in the first color gamut (sRGB) satisfy the following formula (4):

$$Y_{max}(x, y) = Y(x, y) \cdot \frac{D\max}{\max(R, G, B)}. \quad (4)$$

Dmax is a maximum value within a gray-scale range. Dmax is equal to a difference between $2^k$ and 1 (Dmax=$2^K$−1) in a case where gray-scale values that have not been normalized are used. K is a bit width of display signals including gray-scale values of M primary colors (R, G, and B), and K may be set to 8 bits, 10 bits or 12 bits. For example, in a case where K is equal to 8 (K=8), Dmax is equal to 255 (Dmax=255). Alternatively, Dmax is equal to 1 (Dmax=1) in a case where gray-scale values that have been normalized are used.

That is, a ratio of the maximum luminance value $Y_{max}$(x, y) of the first color (e.g., point A) in the first color gamut (sRGB) to the luminance value Y(x, y) of the first color (e.g., point A) in the first color gamut (sRGB) is equal to a ratio of a maximum value Dmax within a gray-scale range to a maximum value of gray-scale values of the M primary colors (R, G, and B) corresponding to the first color (e.g., point A).

Alternatively, a method of obtaining the maximum luminance value $Y_{max}$(x, y) of the first color (e.g., point A) in the first color gamut (sRGB) may be as below.

In S202*a*', a three-dimensional diagram of the first color gamut (sRGB) in a color space is obtained.

For example, gray-scale values (0~255) of the primary colors (R, G, B) may be input to the above formula (1), and then in combination with formula (2) or coordinates of the points of the first color gamut (sRGB) in the color space may be obtained. By connecting all points, a three-dimensional diagram of the first color gamut (sRGB) in the color space, as shown in FIG. 4, may be obtained.

In S202*b*', along a direction of a luminance coordinate axis Y of the color space in FIG. 4, a point, which corresponds to the color coordinate point A(x, y) of the first color (e.g., point A) in the first color gamut (sRGB), on a boundary of the three-dimensional diagram of the first color gamut (sRGB) is obtained. A value of the point on the luminance coordinate axis Y is a maximum luminance value $Y_{max}(x, y)$ of the first color (e.g., point A) in the first color gamut (sRGB).

The point, which corresponds to the color coordinate point A(x, y) of the first color (e.g., point A) in the first color gamut (sRGB), on a boundary of the three-dimensional diagram of the first color gamut (sRGB) refers to an intersection point between a straight line and the boundary of the three-dimensional diagram of the first color gamut (sRGB). The straight line is perpendicular to an xoy plane formed by an x-axis and a y-axis in the color space, and passes through the color coordinate point A (x, y).

Based on this, as shown in FIG. 5, the S202 further includes: obtaining a maximum luminance value $Y_{1max}$(x1, y1) of the second color (e.g., point A1) in the second color gamut (MPC). This step includes the following processes S(i) to S(ii).

In S(i), a three-dimensional diagram of the second color gamut (MPC) in a color space as shown in FIG. 5 is obtained.

For example, the three-dimensional diagram of the second color gamut (MPC) in a color space is obtained according to tristimulus values (X, Y, Z) of each color in the second color gamut, gray-scale values of the N primary colors (e.g., R', G', B', Y', C', and M'), and a conversion matrix Tn2 of the second color gamut.

The conversion matrix Tn2 of the second color gamut (MPC) is a conversion matrix between tristimulus values (X, Y, Z) of the colors in the second color gamut (MPC) and gray-scale values of the N primary colors (e.g., R', G', B', Y', C', and M').

The conversion matrix Tn2 of the second color gamut (MPC) satisfies the following formula (5):

$$\begin{pmatrix} X \\ Y \\ Z \end{pmatrix} = \begin{pmatrix} X_{R'} & X_{G'} & X_{B'} & X_{Y'} & X_{C'} & X_{M'} \\ Y_{R'} & Y_{G'} & Y_{B'} & Y_{Y'} & Y_{C'} & Y_{M'} \\ Z_{R'} & Z_{G'} & Z_{B'} & Z_{Y'} & Z_{C'} & Z_{M'} \end{pmatrix} \begin{pmatrix} R' \\ G' \\ B' \\ Y' \\ C' \\ M' \end{pmatrix}. \tag{5}$$

In this case, gray-scale values (0~255) of the primary colors (R', G', B', Y', C', and M') may be input to the above formula (5), and then in combination with formula (2), color coordinates of the points of the second color gamut (MPC) in a color space may be obtained. By connecting all points, the above three-dimensional diagram may be obtained.

In S(ii), as shown in FIG. 5, along a direction of a luminance coordinate axis Y of the color space, a point, which corresponds to the color coordinate point A1 (x1, y1) of the second color (e.g., point A1) in the second color gamut (WC), on a boundary of the three-dimensional diagram of the second color gamut (MPC) is obtained. A value of the point on the luminance coordinate axis Y is a maximum luminance value $Y_{1max}$(x1, y1) of the second color (e.g., point A1) in the second color gamut (MPC).

The point, which corresponds to the color coordinate point A1(x1, y1) of the second color (e.g., point A1) in the second color gamut (MPC), on the boundary of the three-dimensional diagram of the second color gamut (MPC), refers to an intersection point between a straight line and the boundary of the three-dimensional diagram of the second color gamut (MPG). The straight line is perpendicular to an xoy plane formed by an x-axis and a y-axis in the color space, and passes through the color coordinate point A1 (x1, y1).

The luminance value Y(x, y) and the maximum luminance value $Y_{max}(x, y)$ of the first color (e.g., point A) in the first color gamut (sRGB), and the luminance value Y1(x1, y1) and the maximum luminance value $Y_{1max}$(x1, y1) of the second color (e.g., point A1) in the second color gamut (MPC) satisfy the following formula (6):

$$\frac{Y(x, y)}{Y_{max}(x, y)} = \frac{Y_1(x1, y1)}{Y_{1max}(x1, y1)}. \tag{6}$$

According to the formula (6), the luminance value $Y_1$(x1, y1) of the second color (e.g., point A1) in the second color gamut (MPC) may be obtained. Through the above steps, the color coordinates and luminance information of the color coordinate point A1 (x1, y1, Y1) of the second color (e.g., point A1) in the second color gamut (MPC) may be determined, thereby achieving a conversion of mapping the color coordinate point A(x, y, Y) of the first color in the first color gamut (sRGB) to the color coordinate point A1 (x1, y1, Y1) of the second color in the second color gamut (MPC).

The above steps are all described by taking an example in which the number of primary colors in the first color gamut (sRGB) is less than the number of primary colors in the second color gamut (MPC). In a case where N is less than M (N<M), the above methods are still applicable. That is, for a conversion process in which a first color in a first color gamut with more primary colors is compressed into a second color gamut with less primary colors (i.e., N<M), reference may be made to the above processes of expanding a first color in a first color gamut with less primary colors to a second color in a second color gamut with more primary colors, and details are not described herein again.

Figure 6:
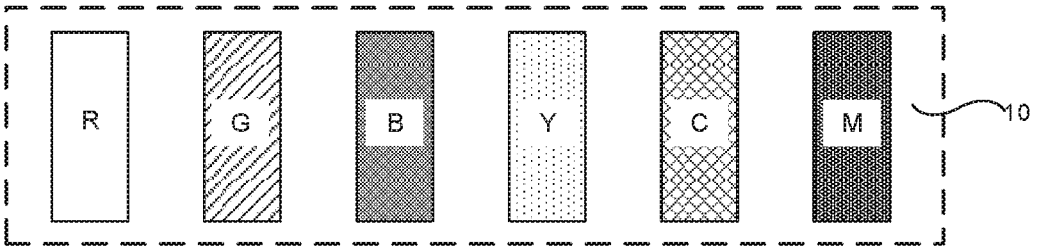
FIG. 6 is a schematic diagram showing a structure of a pixel unit with six primary colors, in accordance with some embodiments of the present disclosure.

Some embodiments of the present disclosure provide a display control method, which is configured to control a display device to perform display. As shown in FIG. 6, the display device includes a plurality of pixel units 10, and each pixel unit 10 includes sub-pixels of N primary colors (e.g., six primary colors). 3 is less than or equal to N (3≤N), and N is a positive integer.

Figure 7:
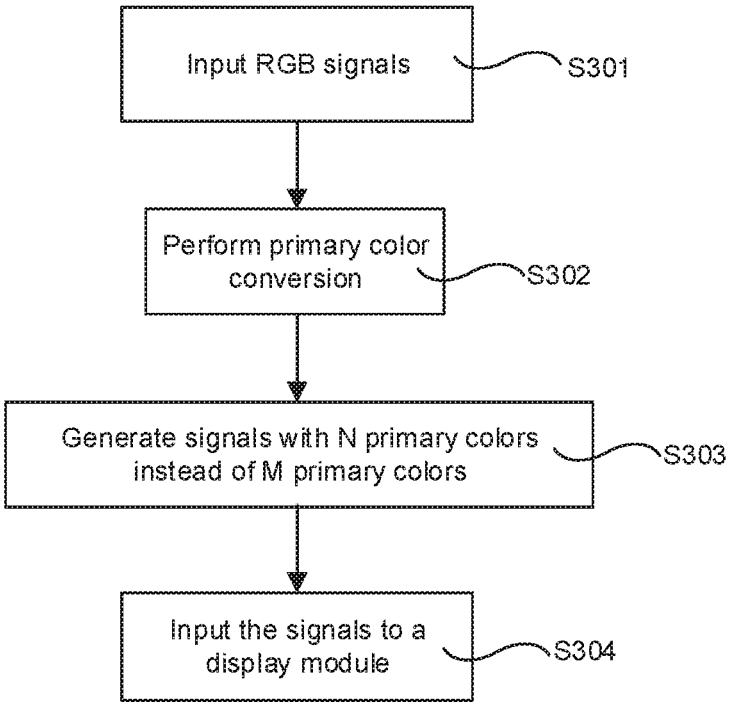
FIG. 7 is a flow chart of a display control method, in accordance with some embodiments of the present disclosure.

As shown in FIG. 7, the display control method includes step 301 to step 304 (S301 to S304).

In S301, RGB signals are input.

For example, gray-scale values (R, G, and B) of sub-pixels of M primary colors (e.g., three primary colors) corresponding to a certain pixel unit in the display device are obtained from an original image. The original image corresponds to display signals with the M primary colors (e.g., RGB signals), The M primary colors of the sub-pixels are in one-to-one correspondence with the M primary colors of a first color gamut (sRGB). 3 is less than or equal to M (3≤M), M is different from N, and M and N are both positive integers.

In S302, primary color conversion is performed.

For example, the primary color conversion method provided by any one of the above embodiments is used to obtain color coordinates and a luminance value A1 (x1, y1, Y1) of a color to be displayed, for example, a second color A1, of the pixel unit in the second color gamut (MPC) having N (e.g., six) primary colors.

The primary color conversion process is the same as described above, and details are not described herein again.

In S303, signals with N primary colors instead of M primary colors signals are generated.

For example, the signals with N primary colors are multi-primary signals.

Gray-scale values of sub-pixels of N primary colors (e.g., R', G', B', Y', C', and M') of the pixel unit are obtained according to the color coordinates and the luminance value A1 (x1, y1, Y1) of the color to be displayed of the pixel unit in the second color gamut (MPC). The N primary colors of the sub-pixels are in one-to-one correspondence with the N primary colors of the second color gamut (MPC).

In S304, the signals are input to a display module.

For example, the display module is a multi-primary display module.

In a case where multi-primary signals include gray-scale values of at least four primary colors, the gray-scale values of the at least four primary colors may be in one-to-one correspondence with at least four sub-pixels in a corresponding pixel unit 10. In this case, the multi-primary signals have a wider bandwidth. In order to input the above signals to the display module, it is necessary to compress the bandwidth of the multi-primary display signals. Then, each primary color of the multi-primary signals is input to a sub-pixel corresponding to the primary color.

In this way, in a case where M<N, multi-primary display may be realized, thereby expanding a color gamut of an image displayed by the multi-primary display module, and improving the expressiveness of the image displayed by the multi-primary display module.

In a case where N<M, a display module with less primary colors may be made to adapt to a display module with more primary colors, so as to expand an application range of signals of the display module with less primary colors.

Some embodiments of the present disclosure provide a primary color converter for performing primary color conversion by using any one of the primary color conversion methods described above. The primary color converter includes a first data processor and a second data processor.

The first data processor is configured to obtain color coordinates A(x, y) and a luminance value Y of a first color (e.g., point A) in a first color gamut (sRGB) having M primary colors (e.g., R, G, and B) according to gray-scale values of the M primary colors corresponding to the first color (e.g., point A).

The second data processor is coupled to the first data processor. The second data processor is configured to map the color coordinates A(x, y) and the luminance value Y of the first color (e.g., point A) in the first color gamut (sRGB) to color coordinates A1 (x1, y1) and a luminance value Y1 of a second color (e.g., point A1) in a second color gamut (MPC) having N primary colors.

3 is less than or equal to M (3<M), 3 is less than or equal to N (3≤N), M is different from N, and M and N are both positive integers.

For example, in a case where M<N, the above primary color conversion method is a multi-primary conversion method; and correspondingly, the above primary color converter is a multi-primary converter.

The primary color converter has the same advantageous effects as the primary color conversion method provided by the embodiments above, and details are not described herein again.

Some embodiments of the present disclosure provide a display device. The display device includes a plurality of pixel units. Each pixel unit includes N sub-pixels. N is greater than or equal to 3 (N≥3), and N is a positive integer. The display device further includes the primary color converter described above.

The display device has the same advantageous effects as the primary color converter provided by the embodiments above, and details are not described herein again.

It will be noted that, in some embodiments of the present disclosure, the above display device may include a liquid crystal display device or an organic light-emitting diode display device. For example, the display device may be any product or component having a display function such as a display, a television, a digital photo frame, a mobile phone, or a tablet computer.

Some embodiments of the present disclosure provide a computer device, which includes a memory and a processor. The memory has stored thereon computer program(s) executable on the processor, and the processor executes the computer program(s) to implement any one of the primary color conversion methods described above. The storage medium includes a read-only memory (ROM), a random access memory (RAM), a magnetic disk, an optical disk, or any other medium that can store program codes.

Some embodiments of the present disclosure provide a computer readable medium storing computer program(s) that, when executed by a processor, cause the processor to implement any of the primary color conversion methods described above.

The foregoing descriptions are merely some specific implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subject to the protection scope of the claims.

What is claimed is:

1. A primary color conversion method, comprising:

obtaining color coordinates and a luminance value of a first color in a first color gamut having M primary colors according to gray-scale values of the M primary colors corresponding to the first color;

mapping the color coordinates and the luminance value of the first color in the first color gamut to color coordinates and a luminance value of a second color corresponding to the first color in a second color gamut having N primary colors, which includes:

obtaining a maximum luminance value $Y_{max}(x, y)$ of the first color in the first color gamut;

obtaining a maximum luminance value $Y_{1max}(x1, y1)$ of the second color in the second color gamut; and obtaining a luminance value $Y_1(x1, y1)$ of the second color in the second color gamut according to a formula:

$$\frac{Y(x, y)}{Y_{max}(x, y)} = \frac{Y_1(x1, y1)}{Y_{1max}(x1, y1)},$$

wherein Y(x, y) is a luminance value of the first color in the first color gamut;

3 is less than or equal to M, 3 is less than or equal to N, M is different from N, and M and N are both positive integers.

2. The primary color conversion method according to claim 1, wherein mapping the color coordinates and the luminance value of the first color in the first color gamut to color coordinates and a luminance value of a second color corresponding to the first color in a second color gamut having N primary colors, further includes:

mapping a color coordinate point A of the first color in the first color gamut to a color coordinate point A1 of the second color corresponding to the first color in the second color gamut having N primary colors, a process of mapping the color coordinate point A of the first color to the color coordinate point A1 of the second color being equal scale mapping.

3. The primary color conversion method according to claim 2, wherein mapping a color coordinate point A of the first color in the first color gamut to a color coordinate point A1 of the second color corresponding to the first color in the second color gamut having N primary colors, a process of mapping the color coordinate point A of the first color to the color coordinate point A1 of the second color being equal scale mapping, includes:

drawing a mapping line segment in a chromaticity diagram, the mapping line segment extending from a color coordinate point D of a white color to the color coordinate point A of the first color;

obtaining a first intersection point P between an extension line of the mapping line segment and a boundary of the first color gamut, and a second intersection point P1 between the extension line of the mapping line segment and a boundary of the second color gamut; and obtaining the color coordinate point A1 of the second color according to a formula:

$$\frac{DA}{DP} = \frac{DA1}{DP_1},$$

wherein

DA is a length of a line segment between the color coordinate point D of the white color and the color coordinate point A of the first color; DP is a length of a line segment between the color coordinate point D of the white color and the first intersection point P; DA1 is a length of a line segment between the color coordinate point D of the white color and the color coordinate point A1 of the second color; and DP1 is a length of a line segment between the color coordinate point D of the white color and the second intersection point P1.

4. The primary color conversion method according to claim 1, wherein obtaining a maximum luminance value $Y_{1max}$(x1, y1) of the second color in the second color gamut, includes:

obtaining a three-dimensional diagram of the second color gamut in a color space; and obtaining, along a direction of a luminance coordinate axis of the color space, a point, which corresponds to the color coordinate point of the second color in the second color gamut, on a boundary of the three-dimensional diagram of the second color gamut, a value of the point on the luminance coordinate axis being a maximum luminance value $Y_{1max}$(x1, y1) of the second color in the second color gamut.

5. The primary color conversion method according to claim 1, wherein obtaining a maximum luminance value $Y_{max}$(x, y) of the first color in the first color gamut, includes:

obtaining tristimulus values of the first color in the first color gamut according to gray-scale values of the M primary colors corresponding to the first color and a conversion matrix of the first color gamut, and using a Y value of the tristimulus values of the first color in the first color gamut as a luminance value Y(x, y) of the first color in the first color gamut, and obtaining the maximum luminance value $Y_{max}$(x, y) of the first color in the first color gamut according to the luminance value Y(x, y) of the first color in the first color gamut, wherein a ratio of the maximum luminance value $Y_{max}$(x, y) of the first color in the first color gamut to the luminance value Y(x, y) of the first color in the first color gamut is equal to a ratio of a maximum value within a gray-scale range to a maximum value of gray-scale values of the M primary colors corresponding to the first color.

6. The primary color conversion method according to claim 1, wherein obtaining a maximum luminance value $Y_{max}$(x, y) of the first color in the first color gamut, includes:

obtaining a three-dimensional diagram of the first color gamut in a color space; and obtaining, along a direction of a luminance coordinate axis of the color space, a point, which corresponds to the color coordinate point of the first color in the first color gamut, on a boundary of the three-dimensional diagram of the first color gamut, a value of the point on the luminance coordinate axis being a maximum luminance value $Y_{max}$(x, y) of the first color in the first color gamut.

7. The primary color conversion method according to claim 1, wherein obtaining color coordinates of a first color in the first color gamut, includes:

obtaining tristimulus values of the first color in the first color gamut according to gray-scale values of the M primary colors corresponding to the first color and a conversion matrix of the first color gamut; and obtaining color coordinates of the first color in the first color gamut according to the tristimulus values of the first color in the first color gamut.

8. The primary color conversion method according to claim 1, wherein M is less than N.

9. A display control method for controlling a display device to perform display, wherein the display device includes a plurality of pixel units, each pixel unit includes sub-pixels of N primary colors, 3 is less than or equal to N, and N is a positive integer, and the display control method comprises:

obtaining gray-scale values of sub-pixels of M primary colors corresponding to a pixel unit from an original image, the M primary colors of the sub-pixels being in one-to-one correspondence with M primary colors of a first color gamut, wherein the original image corresponds to display signals with the M primary colors, 3 is less than or equal to M, M is different from N, and M and N are both positive integers;

using the primary color conversion method according to claim 1 to obtain a luminance value of a color to be displayed of the pixel unit in a second color gamut having N primary colors; and obtaining gray-scale values of the sub-pixels of N primary colors in the pixel unit according to the luminance value of the color to be displayed of the pixel unit in the second color gamut, wherein the N primary colors of the sub-pixels are in one-to-one correspondence with the N primary colors of the second color gamut.

10. A computer device, comprising a memory and a processor, wherein the memory has stored thereon a computer program executable on the processor, and the computer program, when executed by the processor, implements the primary color conversion method according to claim 1.

11. A non-transitory computer-readable storage medium storing a computer program that, when executed by a processor, implements the primary color conversion method according to claim 1.

12. A primary color converter for performing primary color conversion by using the primary color conversion method according to claim 1, wherein the primary color converter comprises a first data processor and a second data processor;

the first data processor is configured to obtain color coordinates and a luminance value of a first color in a first color gamut having M primary colors according to gray-scale values of the M primary colors corresponding to the first color; and the second data processor is coupled to the first data processor, and the second data processor is configured to map the luminance value of the first color in the first color gamut to a luminance value of a second color corresponding to the first color in a second color gamut having N primary colors, wherein 3 is less than or equal to M, 3 is less than or equal to N, M is different from N, and M and N are both positive integers.

13. A display device, comprising a plurality of pixel units, wherein each pixel unit includes N sub-pixels, N is greater than or equal to 3, and N is a positive integer; and the display device further comprises the primary color converter according to claim 12.

14. A primary color conversion method, comprising:

obtaining color coordinates and a luminance value of a first color in a first color gamut having M primary colors according to gray-scale values of the M primary colors corresponding to the first color;

mapping the color coordinates and the luminance value of the first color in the first color gamut to color coordinates and a luminance value of a second color corresponding to the first color in a second color gamut having N primary colors, which includes:

drawing a mapping line segment in a chromaticity diagram, the mapping line segment extending from a color coordinate point D of a white color to a color coordinate point A of the first color;

obtaining a first intersection point P between an extension line of the mapping line segment and a boundary of the first color gamut, and a second intersection point $P_1$ between the extension line of the mapping line segment and a boundary of the second color gamut; and obtaining a color coordinate point A1 of the second color according to a formula:

$$\frac{DA}{DP} = \frac{DA1}{DP_1},$$

the formula of mapping the color coordinate point A of the first color to the color coordinate point A1 of the second color being equal scale mapping, wherein DA is a length of a line segment between the color coordinate point D of the white color and the color coordinate point A of the first color; DP is a length of a line segment between the color coordinate point D of the white color and the first intersection point P; DA1 is a length of a line segment between the color coordinate point D of the white color and the color coordinate point A1 of the second color; and $DP_1$ is a length of a line segment between the color coordinate point D of the white color and the second intersection point $P_1$;

3 is less than or equal to M, 3 is less than or equal to N, M is different from N, and M and N are both positive integers.

15. A display control method for controlling a display device to perform display, wherein the display device includes a plurality of pixel units, each pixel unit includes sub-pixels of N primary colors, 3 is less than or equal to N, and N is a positive integer, and the display control method comprises:

obtaining gray-scale values of sub-pixels of M primary colors corresponding to a pixel unit from an original image, the M primary colors of the sub-pixels being in one-to-one correspondence with M primary colors of a first color gamut, wherein the original image corresponds to display signals with the M primary colors, 3 is less than or equal to M, M is different from N, and M and N are both positive integers;

using the primary color conversion method according to claim 14 to obtain color coordinates of a color to be displayed of the pixel unit in a second color gamut having N primary colors; and obtaining gray-scale values of the sub-pixels of N primary colors in the pixel unit according to the color coordinates of the color to be displayed of the pixel unit in the second color gamut, wherein the N primary colors of the sub-pixels are in one-to-one correspondence with the N primary colors of the second color gamut.

16. A computer device, comprising a memory and a processor, wherein the memory has stored thereon a computer program executable on the processor, and the computer program, when executed by the processor, implements the primary color conversion method according to claim 14.

17. A non-transitory computer-readable storage medium storing a computer program that, when executed by a processor, implements the primary color conversion method according to claim 14.

18. A primary color converter for performing primary color conversion by using the primary color conversion method according to claim 14, wherein the primary color converter comprises a first data processor and a second data processor;

the first data processor is configured to obtain color coordinates and a luminance value of a first color in a first color gamut having M primary colors according to gray-scale values of the M primary colors corresponding to the first color; and the second data processor is coupled to the first data processor, and the second data processor is configured to map the color coordinates of the first color in the first color gamut to color coordinates of a second color corresponding to the first color in a second color gamut having N primary colors, wherein 3 is less than or equal to M, 3 is less than or equal to N, M is different from N, and M and N are both positive integers.

19. A display device, comprising a plurality of pixel units, wherein each pixel unit includes N sub-pixels, N is greater than or equal to 3, and N is a positive integer; and the display device further comprises the primary color converter according to claim 18.

* * * * *